US007545322B2

(12) United States Patent
Newberg et al.

(10) Patent No.: US 7,545,322 B2
(45) Date of Patent: Jun. 9, 2009

(54) ANTENNA TRANSCEIVER SYSTEM

(75) Inventors: Irwin L. Newberg, Pacific Palisades, CA (US); Ike Y. Chang, Santa Monica, CA (US)

(73) Assignee: Raytheon Company, Waltham, MA (US)

( * ) Notice: Subject to any disclaimer, the term of this patent is extended or adjusted under 35 U.S.C. 154(b) by 262 days.

(21) Appl. No.: 11/230,376

(22) Filed: Sep. 20, 2005

(65) Prior Publication Data

US 2008/0030404 A1 Feb. 7, 2008

(51) Int. Cl.
*H01Q 3/00* (2006.01)
*H01Q 1/00* (2006.01)

(52) U.S. Cl. ..... 342/372; 342/370

(58) Field of Classification Search ..... 342/372, 342/370

See application file for complete search history.

(56) References Cited

U.S. PATENT DOCUMENTS 5,281,960 A 1/1994 Dwyer, III
5,493,305 A * 2/1996 Wooldridge et al. ..... 342/368
5,513,383 A * 4/1996 Tsao ..... 455/575.7
5,864,481 A 1/1999 Gross
5,886,667 A * 3/1999 Bondyopadhayay . 343/700 MS
6,097,335 A * 8/2000 Cassen et al. ..... 342/175
6,630,905 B1 * 10/2003 Newberg et al. ..... 342/370
6,810,293 B1 * 10/2004 Chou et al. ..... 700/90
6,847,336 B1 * 1/2005 Lemelson et al. ..... 345/8
7,006,039 B2 * 2/2006 Miyamoto et al. ..... 342/370
7,133,427 B2 * 11/2006 Betin et al. ..... 372/19
7,170,446 B1 * 1/2007 West et al. ..... 342/372
2003/0062464 A1 * 4/2003 Byren et al. ..... 250/201.9
2005/0206583 A1 * 9/2005 Lemelson et al. ..... 345/7

* cited by examiner

*Primary Examiner*—Thomas H Tarcza
*Assistant Examiner*—Harry Liu
(74) *Attorney, Agent, or Firm*—Glenn H. Lenzen

(57) ABSTRACT

Provided is an antenna transceiver system for transmitting and receiving voice, digital data, radar and IR signals, and for processing received signals for use by an operator. The system includes an antenna array having a plurality of radiating elements, each element connected to a transmit/receive ("T/R") module. Each T/R module includes phase shifters, as well as a phase conjugation module for transmitting a return signal to a location along a beam path of an incoming signal. Transmission of the return signal does not require knowledge of the location of either the signal source or the antenna transceiver system. The antenna transceiver system is disposed on a plurality of vertically aligned planes integrated into a compact unit. The units can be embedded in headgear of a user, allowing for hands-free operation of the system. Alternatively, the antenna transceiver system can be integrated into a vehicle, man-transportable backpack, or other designated platforms.

20 Claims, 4 Drawing Sheets

ANTENNA TRANSCEIVER SYSTEM

FIELD OF THE INVENTION

This invention relates generally to a communication system capable of operating over multiple frequency bands to transmit and receive signals. More particularly, this invention relates to an transceiver system integrated into either the headgear of a user or an alternate carrier platform, using a vertically stacked system design, wherein the system transmits and receives signals which may be voice, data, IR and/or RF signals

BACKGROUND

In order to communicate with their commanders or other friendly forces, soldiers must often carry bulky radios having low-gain, omni-directional antennas. These low-gain, omni-directional antennas waste energy by transmitting RF energy in all directions simultaneously. Additionally, omni-directional antennas subject the soldier to an increased risk of detection by enemy forces employing communications countermeasures.

Similar problems exist for firefighters, rescue personnel, law enforcement agencies and other users that are part of a communications network. Omi-directional communication systems require large amounts of power, and the quality of a transmitted or received signal is often relatively poor. Operationally, space and weight restrictions must be considered in addition to the need to communicate effectively. These system limitations may prevent the user, ultimately, from successfully accomplishing a mission.

A further drawback to conventional communications systems is the difficulty associated with integrating components, operating over different frequency bands, into a single, compact, lightweight multi-band system. More specifically, systems designed for voice and data communications do not typically include a capability to track and detect targets using radar. Likewise, these systems do not have infrared ("IR") sensors for receiving and processing IR signals. Modifying conventional sensor/processing arrays to facilitate multi-band data transfer often results in bulky, expensive and difficult to operate systems with limited range and utility. The volume required to house such systems, and the power required to operate them, are often prohibitive.

Hence, there is a need for a communications system that provides for the seamless and efficient transmission and receipt of directed voice and data signals, as well as radar and IR signals used to detect and track targets. The system must be lightweight, compact, and user friendly, allowing for hands-free operation of the system at the discretion of the user.

SUMMARY

The antenna transceiver system herein disclosed advances the art and overcomes problems articulated above by providing an user friendly, integrated system for directed transmission and receipt of multiple signals over a plurality of frequency bands.

In particular, and by way of example only, according to an embodiment, a antenna transceiver system is provided including: a plurality of transmit/receive modules for transmitting and receiving signals; and an antenna array comprising a plurality of radiating elements, wherein the transmit/receive modules and antenna array are formed as integral components of the structure of a platform.

In another embodiment, provided is a headgear worn by a user including: a plurality of transmit/receive modules for transmitting and receiving signals; and an antenna array comprising a plurality of radiating elements, wherein the transmit/receive modules and antenna array are formed as integral components of the structure of the headgear.

In yet another embodiment, a vehicle mounted system for transmitting and receiving radio frequency (RF) signals is provided, including: an active phased array antenna; a plurality of transmit/receive modules for transmitting and receiving RF signals; a means for automatically directing a transmitted signal in a direction of a received signal; a signal processor; a data processor/controller; and a display monitor, wherein the array antenna, transmit/receive modules, directing means, signal processor, and data processor/controller are formed as integral components of the structure of the vehicle.

In still another embodiment, provided is a man-transportable system for transmitting and receiving radio frequency (RF) signals including: an active phased array antenna; a plurality of transmit/receive modules for transmitting and receiving RF signals; a means for automatically directing a transmitted signal in a direction of a received signal; a signal processor; a data processor/controller; and a display monitor, wherein the array antenna, transmit/receive modules, directing means, signal processor, and data processor/controller are formed as integral components of the system.

DETAILED DESCRIPTION

Before proceeding with the detailed description, it should be noted that the present teaching is by way of example, not by limitation. The concepts herein are not limited to use or application with one specific type of antenna transceiver system. Thus, although the instrumentalities described herein are for the convenience of explanation, shown and described with respect to exemplary embodiments, the principles herein may be equally applied in other types of antenna transceiver systems.

Figure 1:
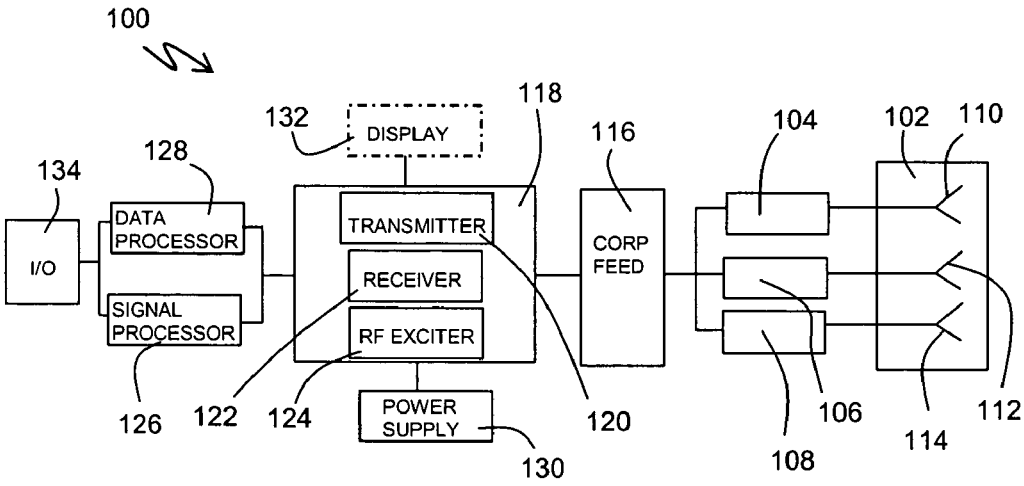
FIG. 1 is a schematic of an antenna transceiver system according to one embodiment of the present invention.

FIG. 1 shows a schematic of an antenna transceiver system 100 for integration into a headgear of a user, or for use with other designated carrying platforms such as a man-transportable backpack or a combat vehicle. In the vehicle mounted configuration, system 100 may be mounted on the vehicle as a "stand alone" subsystem. Alternatively, system 100 may be integrated as an appliqué into the structure or "skin" of the vehicle.

System 100 includes an antenna array 102 which is an active, phased array. The antenna array 102 may be an electronically scanned, phased array ("ESA"), however, it may also be any of a type of phased array antennas well known in the art. Also, a transmit/receive ("T/R") module, of which modules 104, 106 and 108 are exemplary, is associated with each radiating element of the antenna array 102, for example elements 110, 112 and 114. Each individual T/R module, e.g. module 104, scans a small fixed area electronically, thereby negating the need to mechanically move the entire antenna array 102 when realignment of the antenna array 102 is required.

A corporate feed network 116, of a type well known in the art, is positioned to transmit a signal to, or receive a signal from, T/R modules 104, 106, 108. The feed network 116 is coupled to a transceiver unit 118 of standard design. The transceiver unit 118 includes a transmitter module 120 and a receiver module 122. The transceiver unit 118 downconverts signals received by system 100 to an intermediate frequency prior to subsequent amplification and processing of the signals. Alternatively, the transceiver unit 118 upconverts transmission signals to the transmission frequency prior to transmitting the signal to a known or desired receiver. The up and down conversion is facilitated by a signal provided by an RF exciter 124.

Still referring to FIG. 1, system 100 includes a signal processor 126 for processing RF signals received from transceiver unit 118. Similarly, a data processor/controller 128 processes data signals received by system 100. Data processor/controller 128 also controls and directs system 100 functionality, as well as many of the signal manipulation tasks performed by system 100. Of note, signal processor 126 and data processor/controller 128 are of a type well known in the pertinent art. The signal processor 126 and data processor/controller 128 may be co-located with other components of system 100, such as transceiver unit 118. Alternatively, signal processor 126 and data processor/controller 128 may be remotely positioned, for example in a user's backpack or co-located with other vehicle components. When remotely positioned, a data link (not shown) sends and receives signals between the processors 126, 128 and transceiver unit 118.

In addition to signal processor 126 and data processor/controller 128, a power supply 130 is co-located with other components/modules of system 100 (e.g. transceiver unit 118, antenna array 102). Alternatively, power supply 130 may be remotely positioned. The power supply 130 may be, by way of example but not limited to, a conventional battery pack, a solar cell integrated with system 100, or a source of radiated microwaves for providing DC power. In one embodiment, antenna array 102, transceiver unit 118, and other components/modules of system 100, including power supply 130, are integrated into the headgear of a user. Alternatively, power supply 130 can be mounted in a backpack carried by the user. If remotely positioned, a power cable (not shown) connects power supply 130 to the remainder of system 100.

The system 100 includes a display 132 for visually displaying received data. In one embodiment of the present system 100, display 132 is a heads-up display for use with the headgear of a user. In yet another embodiment, display 132 is a display screen or monitor for use with vehicle or man-transportable systems 100. The system 100 also includes an input/output (I/O) interface 134 common in the art.

In the embodiment of system 100 depicted in FIG. 1, antenna array 102 performs as an omni-directional antenna, and system 100 may transmit and receive radio/digital data signals. This mode of operation is the default mode for system 100. Alternatively, as discussed in greater detail below, system 100 transmits and receives well defined directional signals over multiple frequency bands.

Figure 2:
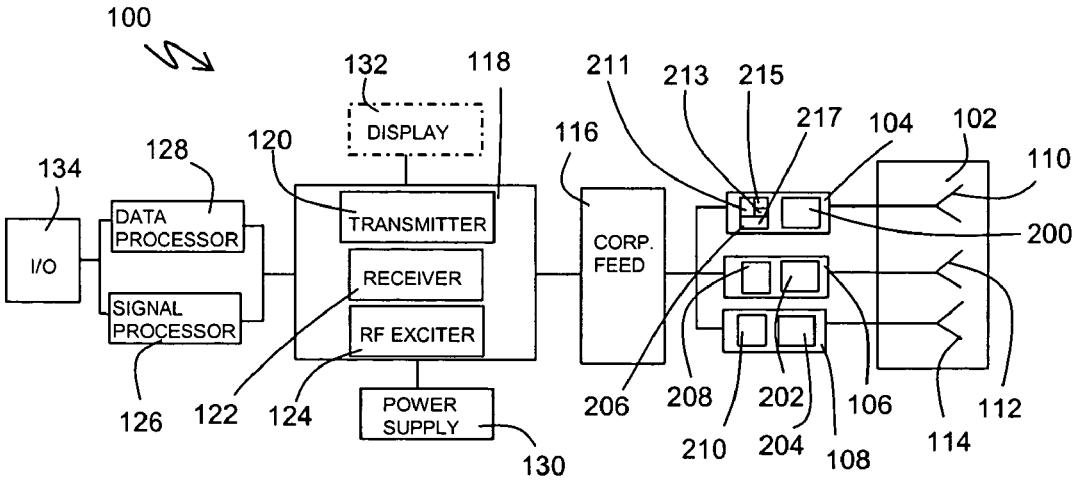
FIG. 2 is a schematic of the antenna transceiver system of FIG. 1 having both a radar signal detection/generation capability and a phase conjugation capability, according to an embodiment.

Referring now to the embodiment of FIG. 2, system 100 includes a plurality of phase shifters, of which phase shifters 200, 202, and 204 are exemplary. The phase shifters 200, 202, 204 are integrated into the T/R modules, e.g. modules 104, 106 and 108. In at least one embodiment, system 100 uses phase shifters, e.g. phase shifters 200, 202, 204, to steer both incoming and outgoing RF signals. Furthermore, with the inclusion of phase shifters 200, 202, 204, system 100 can also be used as a compact radar system to detect and track targets in the field of view ("FOV") of antenna array 102. The FOV may typically be defined by the volume capability or "footprint" of the antenna array. The radar function can be employed contemporaneously with the communication function discussed above, or system 100 can be set to operate in either a "radar only" or "voice/data only" mode.

In addition to providing a radar capability, beam steering (using phase shifters 200, 202, and 204) generates high-gain, high fidelity beams which lead to higher quality line-of-sight ("LOS") transmissions and/or receptions. As opposed to omni-directional antennas, beam steering also decreases the possibility of signal interception. Further, beam steering reduces the overall power required to transmit a given RF signal. Reduced power allows for the use of smaller power supplies 130 with a longer operational life. As discussed above, system 100 has the capability to operate in either a beam steering mode, or as an omni-directional antenna (default mode).

Still referring to FIG. 2, system 100 includes a plurality of phase conjugation modules integrated into the T/R modules 104, 106, 108, such as phase conjugation modules 206, 208, and 210. The specific components and operation of the phase conjugation modules, e.g. phase conjugation module 206, as well as the beam steering technique discussed above, are detailed in U.S. Pat. No. 6,630,905 entitled "System and Method for Redirecting a Signal Using Phase Conjugation" to Newberg et al. The referenced patent is assigned to the present assignee and incorporated by reference herein. More specifically, the phase conjugation modules 206, 208, 210 each include an RF mixer 211, a first 213 and a second switch 215 for helping to switch between receive and transmit mode, and an RF filter 217, all of which function to generate a phase-conjugate wave. Of note, these modules 206-210 do not necessary contain any conventional phase shifters, nor do the modules 206-210 receive conventional steering commands in order to redirect the received signal.

As discussed in the cited reference, phase conjugation results in the transmission of a phase-conjugate wave having a wavefront identical to a wavefront of a corresponding incoming signal. The phase-conjugate wave propagates along a same beam path as the incoming signal, in a direction opposite that of the incoming wave. As such, the phase-conjugate wave is radiated directly back towards the source of the incoming signal, without knowing the incoming signal source location or the location of the receiving transceiver antenna system. When multiple signals are received from a number of locations in the field of view of the transceiver antenna, each signal is independently transmitted back to its respective separate location.

There are numerous operational advantages to a phase conjugation system such as system 100. For example, phase conjugation provides a means for automatically pointing and tracking a transmitted signal. Directional signals of this sort are difficult to intercept, and they provide for higher quality transmissions requiring relatively little power. Further, phase conjugation inherently helps to correct wave distortions induced in a wave as the incoming/outgoing wave passes through a distorting medium. Also, the components of the phase conjugation modules, e.g. module 206, can be used to measure the relative phase between the conjugated signals generated in the T/R modules, e.g. T/R module 104. The phase measurements are then used to calculate the direction of the radiated phase conjugated beam, using algorithms well known in the art. This capability allows system 100 to not only automatically direct a signal to a particular node from which system 100 recently received a signal, but to know the precise location of the node based on the received signal. In this context, the term "node" refers to an electronic source of a previously transmitted and received signal. In addition, coding of the received signals can be used to allow one or more switches to stop the transceiver signals. Thus, the retransmission of a signal from an unwanted source can be prevented.

Figure 3:
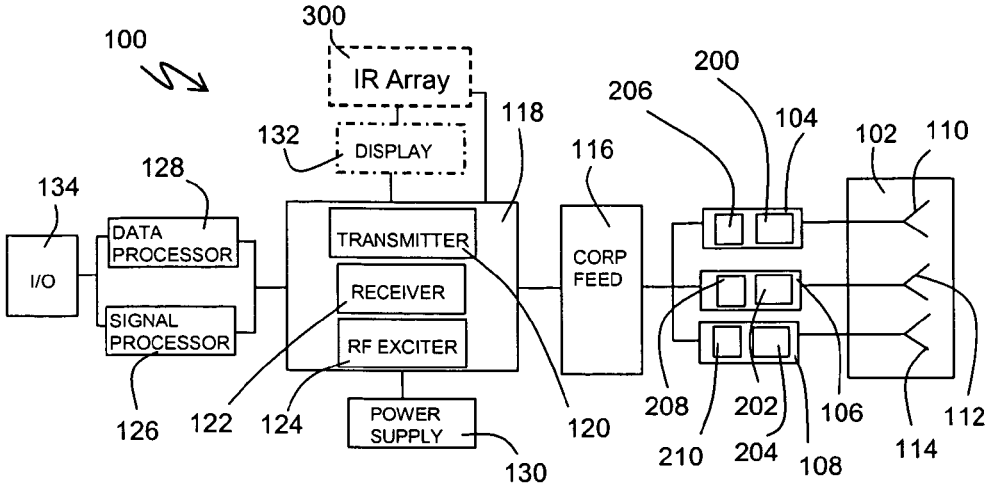
FIG. 3 is a schematic of the antenna transceiver system of FIG. 2 having an IR signal detection capability, according to an embodiment.

Referring now to FIG. 3, one embodiment of system 100 includes an infrared ("IR") receiver array 300 for receiving IR signals emitted or reflected from a source. As can be appreciated by the skilled artisan, infrared waves having a wavelength of 3-5 μm (near-IR) or 8-12 μm (far-IR) are emitted or reflected from natural and man-made objects in the user's environment. These waves are detected by the IR receiver array 300, and processed in signal processor 126. The processed signals produce a thermal image of structure in the FOV of the user, thereby giving the user a night-vision capability. The IR images are viewed on system display 132, which is typically either a heads-up display or a display monitor.

Figure 4:
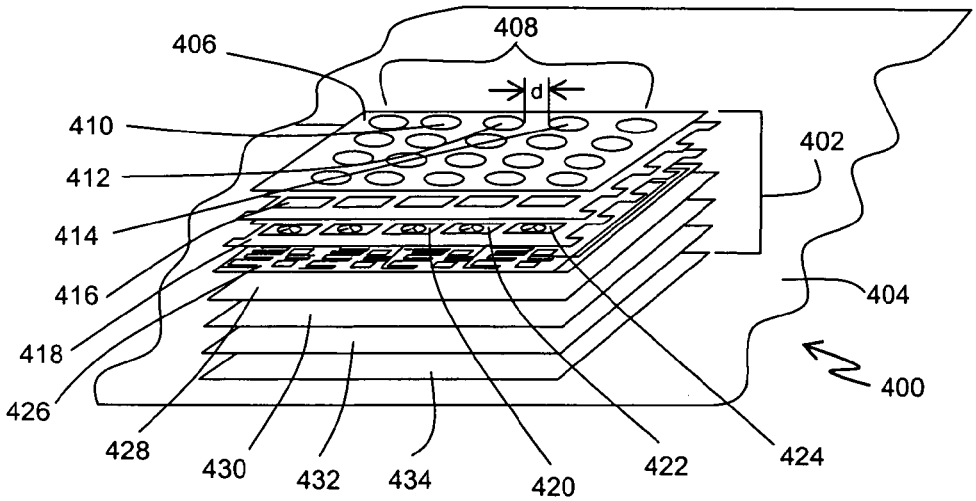
FIG. 4 is a perspective view of an antenna layer lattice according to an embodiment.

The integration of the components and modules discussed above into a stacked compact tile 400 is shown in FIG. 4. The tile 400 includes a plurality of planes 402 positioned vertically in a column relative to an outer surface 404 of a carrier platform (e.g. headgear, vehicle, etc.). A particular vertical configuration, or Array Lattice Layers ("ALL"), incorporated by reference in the present disclosure is detailed in U.S. Pat. No. 5,493,305 entitled "Small Manufacturable Array Lattice Layers" to Woodridge et al. The referenced patent is assigned to the present assignee and is incorporated by reference herein.

As disclosed in the referenced patent to Woodridge et al, the ALL technology provides a low cost, lightweight, low profile implementation of an antenna transceiver system 100. The ALL material or tiles 400 can be efficiently manufactured as reels of laminated material for large-scale production. The ALL technology provides the capability to integrate transceiver system 100 into the structure of a carrier platform, e.g. a helmet, or to lay a stacked structure on an inner or outer surface of a platform, e.g. the inner or outer skin of a vehicle.

Referring once again to FIG. 4, plane 406 includes an antenna array 408 having a plurality of radiating elements, of which elements 410, 412, and 414 are exemplary, positioned in a thin, flexible, multi-layer dielectric film (not shown) of the ALL technology. The number of elements and the distance "d" between any two elements, is related to the operational frequency or frequencies requirements of system 100. In particular, the elements used in a millimeter wave system (300-3000 GHz) are typically smaller than those used for systems operating at frequencies in the range of 1-100 GHz. As such, the number of millimeter wave elements that can be placed within a fixed physical geometry, such as plane 406, is greater than the number of elements possible with a lower frequency system (e.g. 1-100 GHz). The distance "d" between the smaller 300-3000 GHz elements would be correspondingly smaller.

It is possible for system 100 to have multiple arrays 408 operating over different frequency bands. For example, an embodiment of system 100 having a Global Positioning System ("GPS") requires an antenna array 408 operating in L band, which is to say between approximately 1.2-1.5 GHz. The element spacing "d" at those frequencies is about eight inches, therefore, a phase conjugation array having small, closely spaced elements, e.g. elements 410, 412, 414, cannot be used to steer the GPS beam. In this instance, system 100 includes an L-band omni-directional antenna (not shown) to receive and transmit GPS signals. The omni-directional antenna is integrated into tile 400, disposed on one of the many planes 402. Further, antenna array 408 may include extender arms (not shown) for increasing the size of array 408 and the number of radiating elements to provide for lower frequency communications.

In addition to plane 406, system 100 includes a ground plane 416. Further, a plane 418 contains embedded circulators, e.g. circulators 420, 422, and 424, for connecting either a receive circuit or a transmit circuit to an associated radiating element 410, 412, 414. Continuing through the depth of the tile 400, T/R modules, such as T/R modules 104, 106, 108 in FIG. 1, are positioned on a plane 426. In one embodiment, phase shifters such as phase shifters 200, 202, 204 in FIG. 2, and phase conjugation modules such as phase conjugation modules 206, 208, 210, are also located on plane 426.

Other components of system 100, such as transmitter module 120 and receiver module 122 are disposed on planes throughout the depth of the plurality of planes 402. It should be understood that the arrangement of system 100 components and modules disclosed above is by way of example only. The various components and modules of system 100 can be rearranged and located on any number of planes aside from those shown. The present arrangement of components and modules, or an arrangement such as that disclosed in U.S. Pat. No. 5,493,305, are but two of numerous possibilities, depending on specific design requirements and operational considerations for system 100.

In one embodiment, system 100 includes a cold plate 428, or other mechanism for cooling tile 400. As described in U.S. Pat. No. 5,493,305 referenced above, cold plate 428 may have cooling channels (not shown) for cycling coolant through channel manifolds (not shown) to cool array 102 and other system 100 components.

Referring again to the embodiment of FIG. 3, IR receiver array 300 may also be included on one or more of the plurality of planes 402 of FIG. 4. The components of array 300 may be positioned on a single plane, e.g. plane 430, or they may be disposed on a number of planes. Other planes, e.g. planes 432 and 434, include additional components of system 100 such as power supply 130. Further, a signal processor, e.g. signal processor 126, and a data processor/controller, such as data processor/controller 128, are also positioned on one or more of the planes 402. The specific number of planes 402, and the positioning of components and modules on the planes, is dependent on the application and intended use and the corresponding design requirements and considerations of the system, all of which may vary while still remaining true to the intent and scope of the present disclosure.

As disclosed in U.S. Pat. No. 5,493,305, the ALL configuration includes vertically disposed electrical interconnects (not shown) between the planes of a given tile 400, as well as horizontal interconnects (not shown) between tiles. These interconnects include vias (not shown) which may be metal traces, coplanar microwave microbridges, or other techniques well known in the art. Additionally, photodiodes (not shown) and fiber optic cables (not shown) may be incorporated into the tile 400 stack to provide optical signal transfer between the plurality of planes 402.

Figure 5:
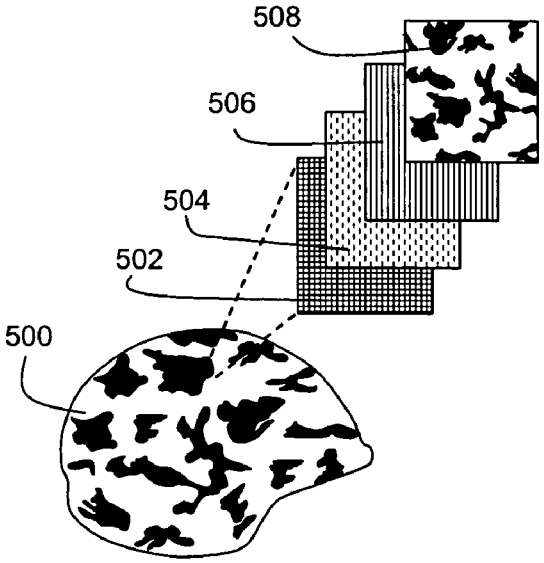
FIG. 5 is an exploded view of a transceiver system integrated into the layers of a headgear worn by a user, according to an embodiment.

The integration of system 100 into a user designated platform, such as a helmet 500, is depicted in FIG. 5, however, the system may, in fact, be used on any number of platforms, as will be discussed in greater detail below. As shown in FIG. 5, the layers of helmet 500 include Kevlar 502, or another composite material which is the base protection layer for helmet 500. The transceiver system 100, in the ALL configuration, is positioned as a layer 504 between the layer of Kevlar 502 and a radome 506. The radome 506 is also a composite material shaped to match the shape of helmet 500. The outside layer 508 or surface is a camouflage layer, typically made of cloth and containing any one of a number of a camouflage patterns.

In the particular embodiment shown in FIG. 5, transceiver system 100 is embedded in the structure of helmet 500. In an alternate embodiment, system 100 is mounted as an appliqué to helmet 500, immediately below or on top of outer layer 508.

Figure 6:
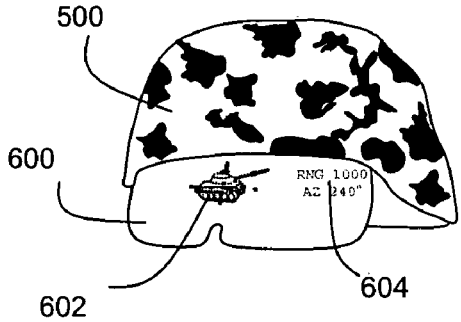
FIG. 6 is a perspective view of a heads-up display, according to an embodiment.

Cross-referencing for a moment FIGS. 5 and 6, the helmet 500 mounted embodiment of system 100 may include a heads-up display 600 attached to helmet 500. The heads-up display 600 can project for the user images 602 of targets, either in the user's line of sight, or elsewhere within the FOV of antenna array 102. The target data may result from IR signals received by system 100, RF signals received, or by both. Stated differently, in one embodiment of system 100, the user can choose between projected IR images or radar data. Additional relevant data and information 604 can also be displayed as well, as shown in FIG. 6. In one embodiment, heads-up display 600 is rigidly fixed to helmet 500. In yet another embodiment, display 600 can either be removed from helmet 500, or folded out of the way of the user when not in use.

Figure 7:
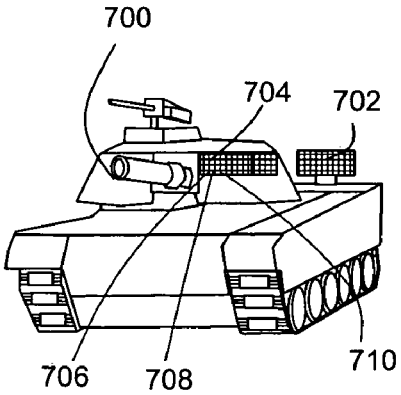
FIG. 7 is a perspective view of a vehicle mounted system, according to an embodiment.
Figure 8:
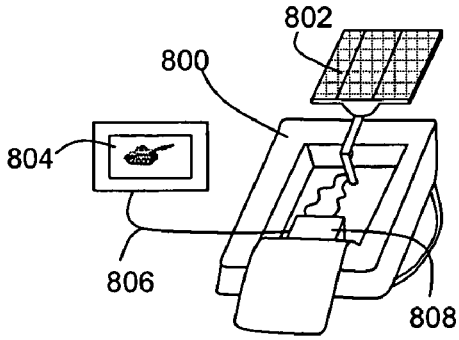
FIG. 8 is a perspective view of a backpack mounted system, according to an embodiment.

In alternate embodiments, as shown in FIGS. 7 and 8, system 100 is mounted onto, and integrated into, a vehicle system or man-transportable backpack. FIG. 7 depicts a vehicle 700 mounted system 100. As shown, system 100 may be mounted as a separate vehicle 700 subsystem 702. Alternatively, system 100 may be integrated into the structure of vehicle 700, using a plurality of appliqués, of which appliqué 704 is exemplary. Each appliqué 704 includes a plurality of ALL tiles, such as tiles 706, 708 and/or 710.

With a backpack 800 mounted system 100, an array 802 of ALL tiles can be attached to and stored in backpack 800. As shown in FIG. 8, system 100 includes a portable display monitor 804 connected via cable 806 to a housing 808. The housing 808 typically includes system 100 electronics such as power supply 130. The backpack 800 based system 100 depicted in FIG. 8 is operated while the user is either stationary or moving, and includes an interconnect to a heads-up display 600 integrated into a helmet 500 of the user.

Figure 9:
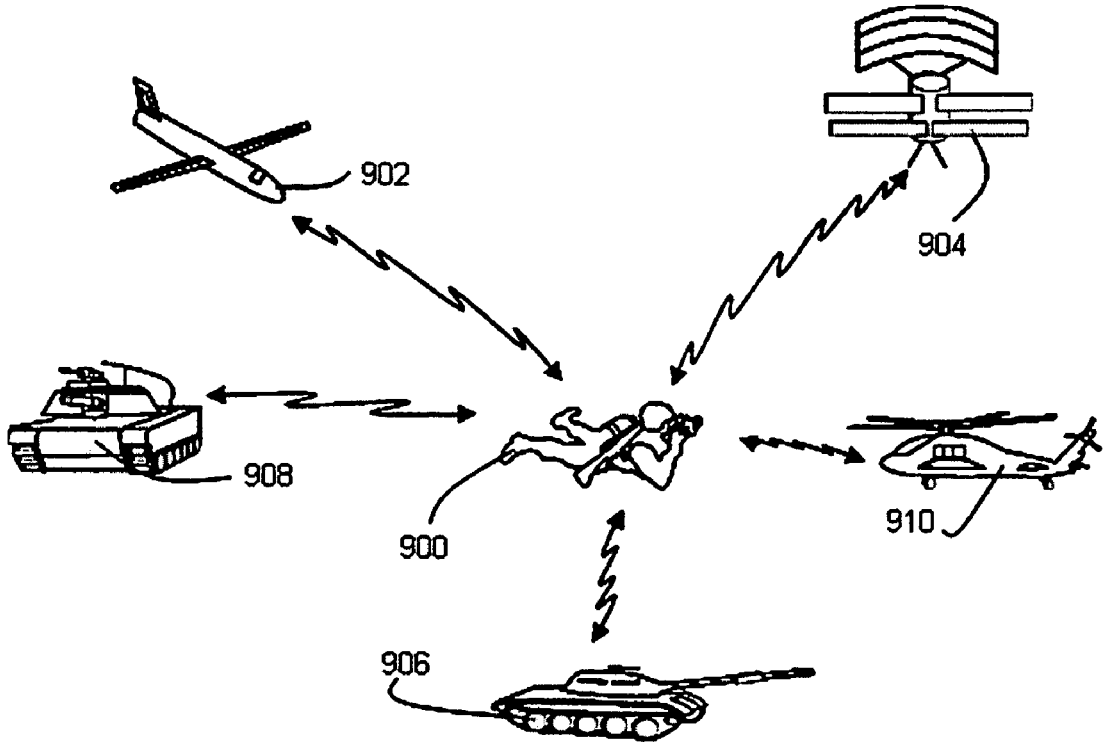
FIG. 9 is a representation of an operational environment wherein a user transmits and receives a plurality of signals, according to an embodiment.

Operationally, as shown in FIG. 9, system 100 is deployed to support communications between a user 900 and any number of supporting systems. For example, user 900 may be cued by, and receive data from, an unmanned aerial vehicle ("UAV") 902 or a satellite 904. In particular, UAV 902 or satellite 904 may serve as a relay station for passing data between user 900 and a second communication means. For example, user 900 may be cued as to the location of an enemy system 906 based on information received by a second user in the area. An individual user 900 may also receive communications from vehicles 908 within the FOV of system 100. The vehicles 908 may be equipped with an antenna transceiver system 100, or they may communicate with user 900 by more conventional means. Also, user 900 may detect IR or RF signals from an unknown system 910. The system 100 processes the signals to identify whether system 910 is friend or foe.

Figure 10:
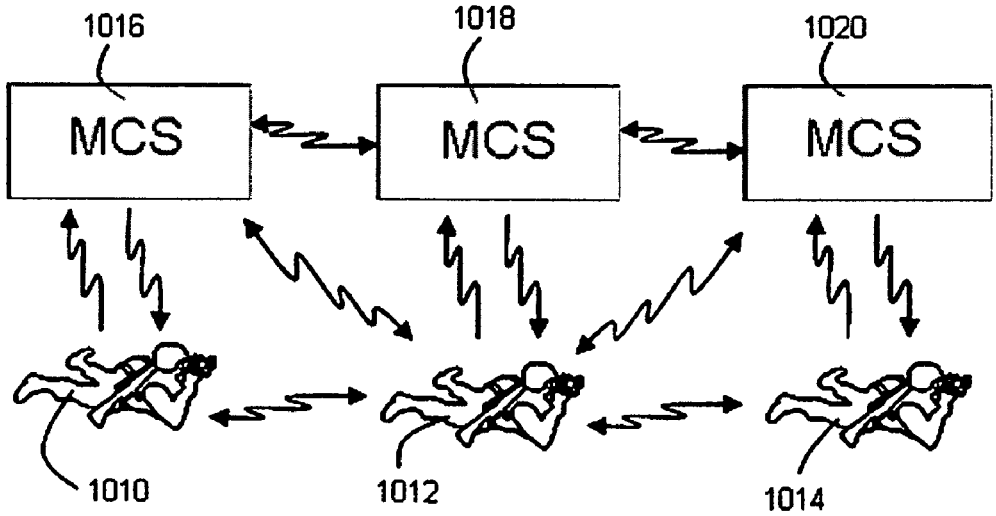
FIG. 10 is a representation of a multiple "master communication station" environment, according to an embodiment.

FIG. 10 depicts yet another scenario wherein multiple users, e.g. users 1010, 1012 and 1014 can communicate with each other, with their own Master Control Station ("MCS") or with other MCSs, e.g. MCSs 1016, 1018 and 1020. The ability to pass data freely between users 1010, 1012, 1014 and MCSs 1016, 1018, 1020 respectively significantly enhances efficiency and increases the probability of mission success. Although the users, e.g. user 1010, depicted in FIG. 10 are soldiers, use of system 100 is not limited to military applications. Firefighters, law enforcement, rescue personnel and users requiring hands-free communications can benefit from one or more of the embodiments disclosed above.

Changes may be made in the above methods, devices and structures without departing from the scope hereof. It should thus be noted that the matter contained in the above description and/or shown in the accompanying drawings should be interpreted as illustrative and not in a limiting sense. The following claims are intended to cover all generic and specific features described herein, as well as all statements of the scope of the present method, device and structure, which, as a matter of language, might be said to fall therebetween.

What is claimed is:

1. An antenna transceiver system comprising:

a plurality of transmit/receive modules for transmitting and receiving signals, each transmit/receive module comprising a phase conjugation module; and an antenna array comprising a plurality of radiating elements, wherein the transmit/receive modules and antenna array are components integrated as structural elements of a platform, the platform comprising a plurality of planes aligned vertically relative to an outer surface of the platform, wherein the transmit/receive modules are disposed on a first plane of the plurality of planes and the antenna array is disposed on a second plane of the plurality of planes.

2. The system of claim 1 further comprising:

a power supply;

a signal processor;

and a data processor/controller.

3. The system of claim 2, wherein the power supply, signal processor and data processor/controller are formed as integral components of the structure of the platform.

4. The system of claim 1, wherein the frequencies of transmitted and received signals are in the range of 1-100 GHz.

5. The system of claim 1, wherein the frequencies of transmitted and received signals are in the range of 300-3000 GHz.

6. The system of claim 1 further comprising an infrared (IR) receiver array for detecting IR signals, wherein the IR receiver array is formed as an integral component of the structure of the platform.

7. The system of claim 1 further comprising a global positioning system receptor for transmitting and receiving geolocation data.

8. The system of claim 1 further comprising extender arms for increasing the size of the antenna array.

9. The system of claim 1 further comprising a cold plate for cooling the antenna array and transmit/receive modules.

10. The system of claim 1, wherein the antenna array is an electronically scanned array including a plurality of phase shifters for electronically steering transmitted and received RF signals.

11. The system of claim 1, wherein each phase conjugation module of the plurality of transmit/receive modules comprises:

a RF mixer;

a first switch;

a second switch; and a filter wherein the RF mixer, first switch, second switch and filter are used to generate a transmitted signal having a wavefront identical to a wavefront of a received signal, and further wherein the transmitted signal travels along a beam path of the received signal to a source of the received signal.

12. The system of claim 11, wherein a location of the source of the received signal and a location of the antenna transceiver system are unknown.

13. The system of claim 11, wherein the receive signal is coded to prevent the generation of a transmitted signal.

14. The system of claim 1, wherein the plurality of radiating elements are arrayed in a multi-layer dielectric film.

15. The system of claim 14, wherein at least one logic chip is positioned on the dielectric film, and further wherein RF, direct current and input/output connectors for interconnecting the radiating elements and the logic chip are embedded in the dielectric film.

16. The system of claim 15, wherein the connectors are selected from a group consisting of metal traces or fiber optic interconnects.

17. The system of claim 1, wherein the platform is a headgear.

18. The system of claim 17, further comprising a heads-up display for visually displaying data received by the system.

19. The system of claim 1, wherein the platform is a vehicle.

20. The system of claim 14, wherein the multi-layer dielectric film is flexible.

* * * * *